United States Patent [19]

Fukutomi

[11] Patent Number: 4,800,607

[45] Date of Patent: Jan. 31, 1989

[54] APPARATUS FOR CLEANING WINDOWPANES

[75] Inventor: Osamu Fukutomi, Tokyo, Japan

[73] Assignee: Nihon Biso Kabushiki Kaisha, Tokyo, Japan

[21] Appl. No.: 40,644

[22] Filed: Apr. 21, 1987

[51] Int. Cl.[4] ..... A47L 1/00

[52] U.S. Cl. ..... 15/103; 15/302; 15/50 R

[58] Field of Search ..... 15/103, 50 R, 50 A, 15/50 C, 302

[56] References Cited

U.S. PATENT DOCUMENTS

| | | | |
|---|---|---|---|
| 1,489,799 | 4/1924 | Tiscornia | 15/103 |
| 3,454,976 | 7/1969 | Kijinski | 15/103 X |
| 3,461,476 | 8/1969 | North | 15/103 X |
| 3,795,930 | 3/1974 | Leifheit | 15/50 C |
| 3,999,242 | 12/1976 | Maruyama | 15/103 X |
| 4,025,984 | 5/1977 | Hoener | 15/302 |

FOREIGN PATENT DOCUMENTS

| | | | |
|---|---|---|---|
| 47901 | 1/1979 | Japan | 15/103 |

*Primary Examiner*—Philip R. Coe
*Assistant Examiner*—K. L. O'Leary
*Attorney, Agent, or Firm*—Hedman, Gibson, Costigan & Hoare

[57] ABSTRACT

An apparatus for cleaning windowpanes of a building comprises a unit suspended from the roof of the building and being capable of ascending and descending along the building. An opening portion is formed in the front portion of the unit and a cleaning head is provided in this opening portion. The cleaning head can be adjusted in its position and can be accurately positioned against a windowpane to be cleaned by reducing a relative velocity of a scraper attached to the cleaning head to zero by ascending the cleaning head while the unit is descending. The scraper and a rotary disc for sprinkling water are secured to a movable member provided in the cleaning head. The scraper can not only approach and withdraw from the windowpane but also incline with respect to the windowpane. An air curtain is formed below the scraper so as to guide soiled water left after wiping of the windowpane by the scraper into a soiled water collection portion.

3 Claims, 7 Drawing Sheets

APPARATUS FOR CLEANING WINDOWPANES

BACKGROUND OF THE INVENTION

This invention relates to an improvement of an apparatus for cleaning windowpanes of a building and, more particularly, to an apparatus capable of wiping a windowpane of a multistoried building efficiently and safely by wiping off dust deposited on the windowpane while sprinkling water on the windowpane and collecting the wiped off dust.

For keeping windowpanes of a multistoried building clean, these windowpanes need to be cleaned regularly. A conventional method for cleaning windowpanes of a multistoried building relies on a hand work according to which a workman on a gondola suspended from the roof of the building sprinkles water on the windowpanes and then wipes off dust with a scraper. The conventional method however is apparently inefficient and dangerous.

For overcoming the defects of the conventional cleaning method, there has been proposed, as disclosed in Japanese Utility model Publication No. 58-22680, an apparatus for automatically cleaning windowpanes of a multistoried building. This apparatus comprises, as shown in FIG. 7, a cleaning unit 1 suspended from the roof of a building and being capable of ascending and descending along the outer wall of the building, a pair of vertically arranged scrapers 2 and 3 which are provided in the cleaning unit 1 so that they can abut against a windowpane and move forwardly and rearwardly and a sprinkling nozzle 4 provided between the scrapers 2 and 3. Water is sprinkled by the sprinkling nozzle 4 over the windowpane while the cleaning unit 1 is descending and soiled water containing dust is scraped off by the upper scraper 2 and is recovered by the lower scraper 3 into a soiled water tank (not shown).

The proposed apparatus however has the disadvantage that frictional resistance caused during descending of the cleaning unit 1 is very large since the cleaning unit 1 descends while the upper and lower scrapers 2 and 3 are in abutting engagement against the windowpane. Difficulty arises particularly when windowpanes of a wide range are to be cleaned all at once by a plurality of horizontally arranged cleaning apparatuses.

The prior art apparatus has also the problem that the sprinkling nozzle tends to b blocked with foreign matters mixed in sprinkling water or dust scraped off during cleaning with a result that the nozzle loses its water sprinkling function.

Further, in the prior art apparatus in which the cleaning unit 1 descends while the scrapers 2 and 3 are in abutting engagement with the windowpane, if moving of the scrapers 2 and 3 forwardly and rearwardly during cleaning is not made at a proper timing, there will remain an unwiped area in the windowpane.

If it is attempted to adjust the position of the cleaning unit 1 for preventing occurrence of the unwiped area, the position of the cleaning unit 1 which is heavy and wide must be finely adjusted with a result that a skill and complex control for such fine adjustment are required.

It is, therefore, an object of the invention to provide an apparatus for cleaning windowpanes capable of reducing frictional resistance relative to windowpanes and thereby smoothly cleaning the windowpanes.

It is another object of the invention to provide an apparatus for cleaning windowpanes capable of preventing blocking of a sprinkling element and attaining complete cleaning without occurrence of an unwiped area on the windowpanes.

SUMMARY OF THE INVENTION

For achieving the objects of the invention, the appratus for cleaning windowpanes according to the invention is characterized in that it comprises a unit capable of ascending and descending along a side surface of a structure and formed with an opening portion in a portion facing a windowpane, a cleaning head provided vertically movably in said opening portion of said unit, a movable member provided in said cleaning head, means for moving said movable member to approach and withdraw from the windowpane and also incline with respect to the windowpane, a scraper mounted on said movable member for cleaning the windowpane in abutting engagement therewith, a rotary disc mounted on a rotary shaft which is substantially vertically provided with respect to said movable member, cleaning water supply means for dripping cleaning water onto said rotary disc, means for forming an air curtain provided below said movable member in said cleaning head, said air curtain being formed opposite to said scraper and guiding soiled water flowing along the windowpane, and soiled water collecting means for collecting soiled water guided along said air curtain.

According to the invention, the opening portion facing the windowpane is formed in the front portion of the unit suspended from the roof of a structure such as a building and being capable of ascending and descending along the structure, a cleaning head is provided in this opening portion and this cleaning head is capable of being adjusted in its position and being positioned accurately to vertical corner portions of the windowpane by ascending or descending in a state in which there is no relative velocity during descending of the unit, a scraper and a rotary disc for sprinkling water are secured to a movable member provided in this cleaning head and thereby are moved towards and away from the windowpane and the scraper can not only be moved towards and away from the windowpane but also incline with respect to the windowpane. Accordingly, the windowpane can be wiped without using a high pressure pump and a nozzle so that there is no blocking of the nozzle and besides corner portions of the windowpane can be completely wiped. Further, the provision of the air curtain below the scraper contributes to reduction of frictional resistance, for the soiled water can be collected with the gap between the cleaning head and the windowpane being blocked in a non-contacting state. Furthermore, since the cleaning head housing the scraper can ascend and descend relative to the unit, the position of the scraper and other elements can be finely adjusted and the occrrence of an unwiped area on the windowpane thereby can be eliminated.

A preferred embodiment of the invention will now be described with reference to the accompanying drawings.

BRIEF DESCRIPTION OF THE DRAWINGS

In the accompanying drawings.

DESCRIPTION OF A PREFERRED EMBODIMENT

Referring to FIGS. 1 through 6, a preferred embodiment of the invention will be described.

Figure 1:
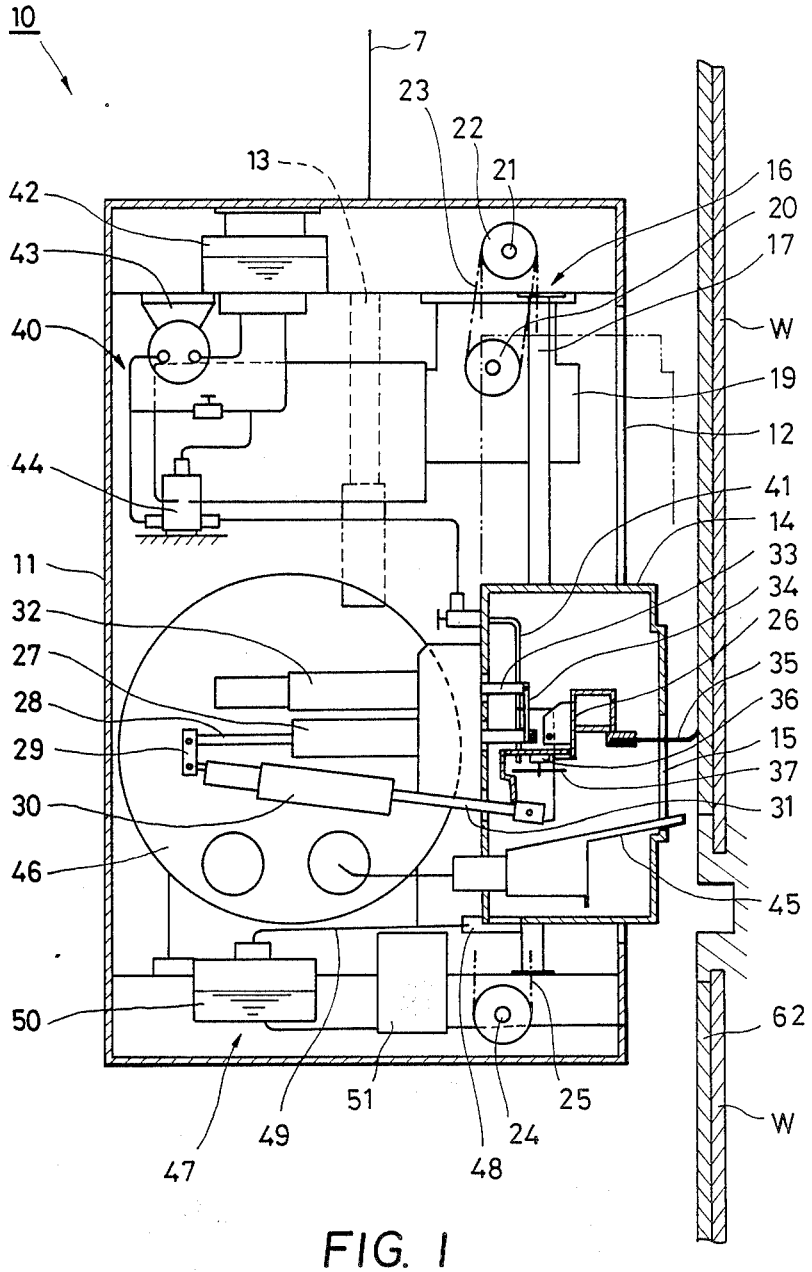
FIG. 1 is a cross sectional view of a preferred embodiment of the invention.
Figure 2:
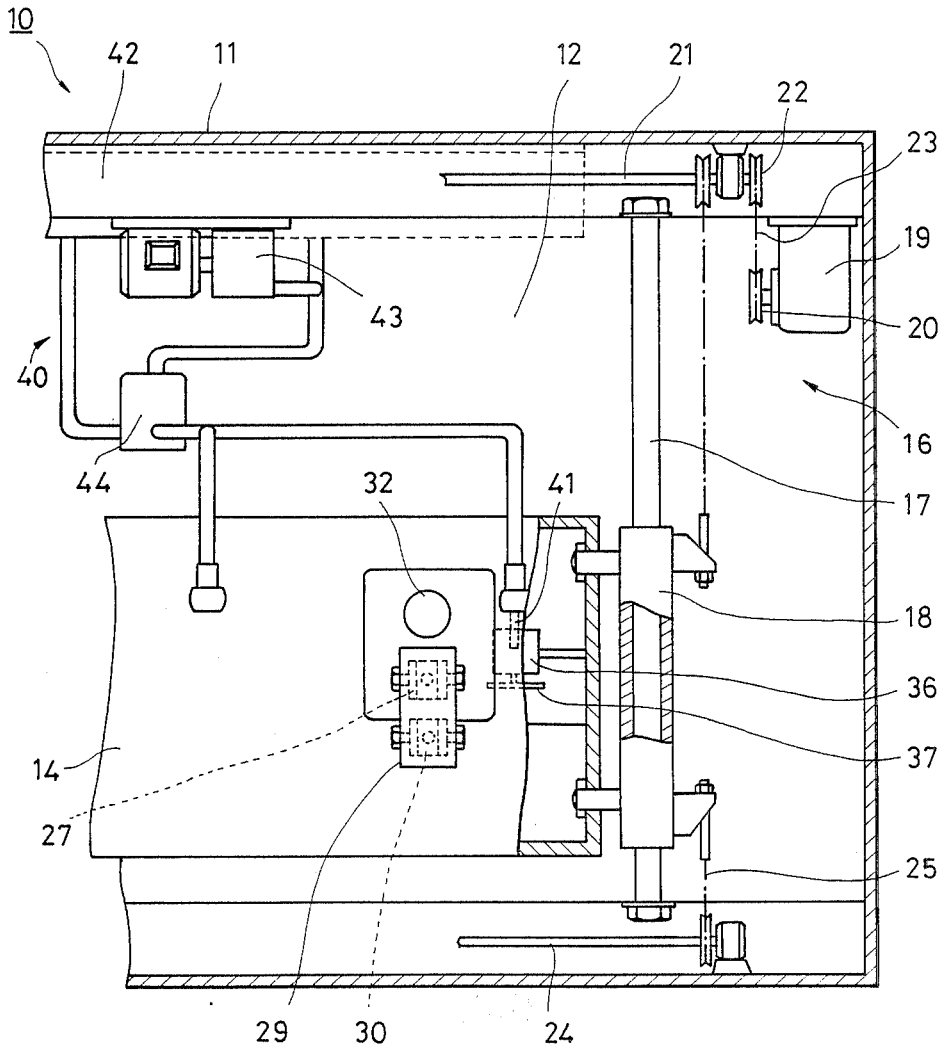
FIG. 2 is a vertical sectional view of the embodiment.
Figure 3A:
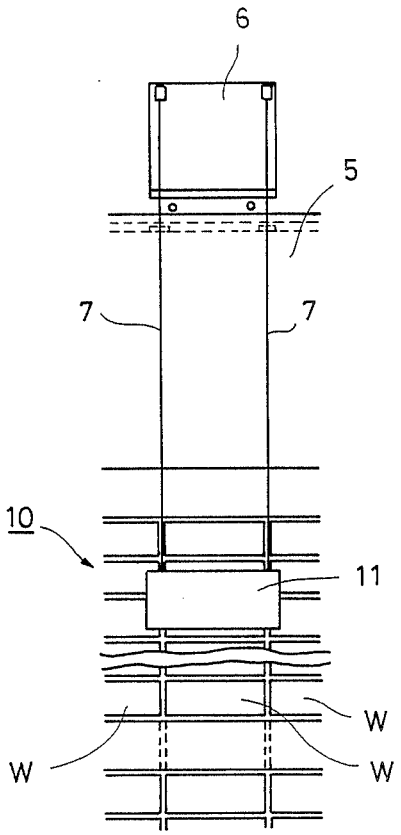
FIGS. 3 (*a*) and 3(*b*) are a front view and a side view of the embodiment in working condition.
Figure 3B:
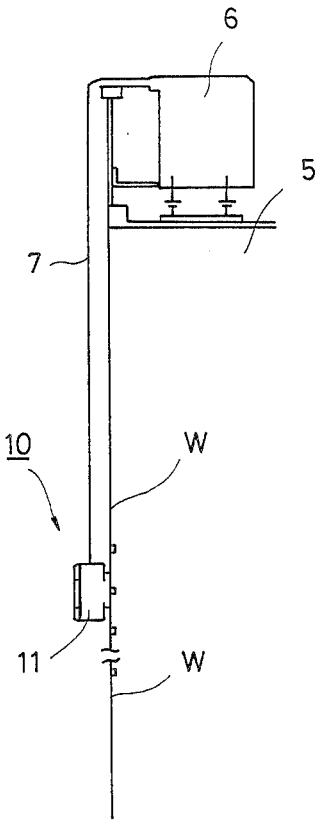

A cleaning apparatus 10 comprises, as shown in FIGS. 1 and 2, a horizontally elongated box-like unit 11. This unit 11 is formed with a horizontally elongated opening portion 12 in the front portion of the unit 11 facing a windowpane W. As shown in FIG. 3, this unit 11 is caused to ascend and descend along a side wall portion of a building 5 by means of a pair of wires 7 suspended from a roof car 6 which is adapted to run along rails laid on the roof of the building 5. On the side portions of the unit 11 are provided horizontal balancing devices 13 which balance the unit 11 suspended by the wires 7 horizontally by adjusting positions of balancers in response to a balance detection signal from a horizontal balance detector (not shown).

In the unit 11, there is provided a cleaning head 14 which is adapted to ascend and descend within the opening portion 12.

This cleaning head 14 is of a horizontally elongated box-like shape like the unit 11 and is formed with a horizontally extending slit 15. A lift device 16 for this cleaning head 14 is constructed, as shown in FIG. 2, a pair of guide shafts 17 secured to the portions of the unit 11 in the vicinity of its two sides and sliders 18 which are in fitting engagement with the guide shafts 17 and fixed to the cleaning head 14. A lift motor 19 is mounted on the upper portion of the unit 11. A sprocket 20 of this lift motor 19 is coupled through a chain 23 with a sprocket 22 of a rotation shaft 21 disposed in the upper portion of the unit 11 in parallel with the windowpane W. The rotation shaft 21 and a rotation shaft 24 provided horizontally in the lower portion of the unit 11 are respectively connected to the sliders 18 via sprockets secured to these rotation shafts 21 and 24 and chains which are wound on one end thereof on these sprockets and secured on the other end thereof to the sliders 18. Thus, the ascending and descending movements of the cleaning head 14 are effected by driving the lift motor 19. The ascending velocity of the cleaning head 14 and the descending velocity of the unit 11 can be adjusted in such a manner that the two velocities become substantially equal to each other thereby bringing about a state in which there is no relative velocity of a scraper to be described later with respect to the windowpane W.

A movable member 26 is provided in this cleaning head 14. The movable member 26 is pivotably secured by means of a pin to the foremost end of a guide rod 28 which is inserted in a guide cylinder 27 extending vertically with respect to the windowpane W and secured integrally to the cleaning head 14. The movable member 26 is also secured pivotably by means of a pin to the foremost end of a rod 31 of a tilting cylinder 30 which is pivotably secured by means of a pin to a connection plate 29 fixedly secured to the root portion of the guide rod 28. The foremost end portion of a rod 33 of an approaching and withdrawing cylinder 32 which is fixedly secured to the cleaning head 14 is connected by means of a pin to a connection plate 34 secured to the foremost end of the guide rod 28.

Accordingly, the movable member 26 is moved horizontally in the cleaning head 14 with the guide cylinder 27 reciprocating along the guide rod 28 by stretching and withdrawing the rod 33 of the approaching and withdrawing cylinder 32. Besides, the movable member 26 is pivotably moved about the pin at the foremost end of the guide rod 28 by stretching and withdrawing the rod 31 of the tilting cylinder 30. Thus, the movable member 26 can approach and withdraw from the windowpane W and can also be tilted with respect to the windowpane W.

To the movable member 26 is mounted an elongated scraper 35 made of a flexible material such as rubber. This scraper 35 projects outwardly from the slit 15 of the cleaning head 14 for wiping dust and soil deposited on the windowpane in abutting engagement therewith.

Figure 4:
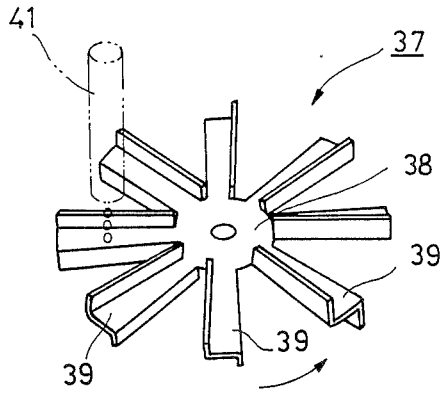
FIG. 4 is a perspective view of a rotary disc.

A plurality of water sprinkling motors 36 are mounted at a suitable interval on the movable member 26. The rotation shaft of each of these sprinkling motors 36 projects downwardly and a rotary disc 37 is secured horizontally to the rotation shaft for sprinkling cleaning water dropped thereon towards the windowpane W due to centrifugal force. As shown in FIG. 4, this rotary disc 37 is formed with flat portions 39 (eight in the illustrated example) extending radially from a central mounting portion 38 by which the rotary disc 37 is mounted to the water sprinkling motor 36. The rear portion of each flat portion 39 as viewed in the direction of rotation of the disc is bent upwardly and the front portion of the flat portion 39 is bent downwardly.

Cleaning water supply means 40 for supplying cleaning water comprises a cleaning water dripping tube 41 provided behind the water sprinkling motor 36 which is connected to a cleaning water tank 42 via a cleaning water pump 43 and an electromagnetic valve 44.

For collecting soiled water left after wiping the windowpane W with the scraper 35 while sprinkling the cleaning water on the windowpane W, an elongated air curtain nozzle 45 formed in the foremost end portion thereof with a horizontally extending nozzle opening is provided below the scraper 35 in the cleaning head 14. The nozzle 45 functions to block the gap between the windowpane W and the cleaning head 14 in a noncontacting sate with compressed air supplied from a blower 46 provided in the unit 11. For soiled water collection means 47, a recessed portion 48 is formed in the bottom portion of the cleaning head 14. This recessed portion 48 is communicating with a soiled water tank 50 provided in the lower portion of the unit 11 through a collecting tube 49. A draining pump 51 is connected to the soiled water tank 50 to suck and drain the collected soiled water from the soiled water tank 50.

Figure 5:
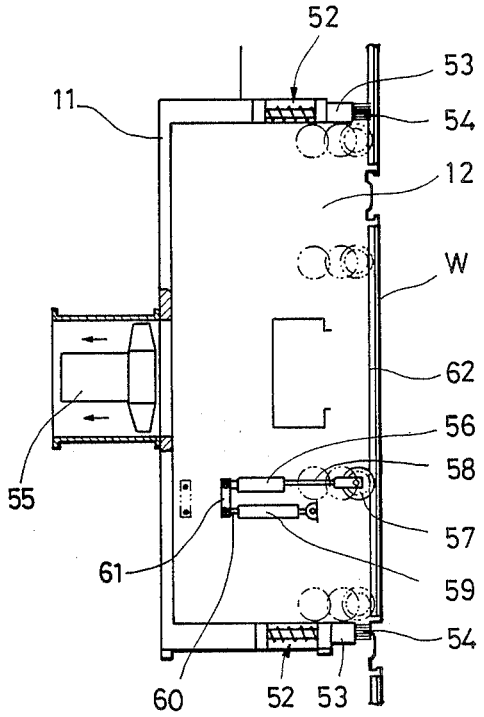
FIG. 5 is a side view of a portion including suction fans and guide rollers.

As shown in FIG. 5, cushion members 53 and brushes 54 are secured to the unit 11 via a cushion mechanism 52 consisting of a spring for sealing and supporting the unit 11 against reaction produced during the cleaning work. By sucking out air inside the unit 11 by suction fans 55 mounted on the rear wall of the unit 11, the unit 11 is sucked to the windowpane W. On both sides of the unit 11 are vertically provided four pairs of roller guides 56. Roller supporting rods 58 provided at the foremost end portions thereof with guide rollers 57 are inserted through the roller guides 56. Rods 60 of stretching and withdrawing cylinders 59 mounted on the unit 11 are connected through connection plates 61 to the roller supporting rods 58 so as to change the position of the guide rollers 57.

The guide rollers 57 on both sides of the unit 11 are adapted to roll along guide rails 62 provided temporarily or permanently on both sides of the windowpane W thereby to ensure smooth ascending and descending of the unit 11 without its moving away from the windowpane W or its colliding with an obstacle.

The cleaning operation by the windowpane cleaning appratus 10 of the above described construction will now be described.

First, the unit 11 suspended from the roof car 6 is lowered to a predetermined position. The guide rails 62 are provided on both sides of the windowpane W to be cleaned, the guide rollers 57 are positioned on the guide rails 62 and the unit 11 is lowered to the upper portion of the uppermost windowpane W.

Then the suction fans 55 are started to cause the unit 11 to be sucked to the wall surface of the building 5. The blower 46 is started for enabling compressed air to be supplied to the respective cylinders 30, 32 and 59 and the air curtain nozzle 45. Further, the cleaning water pump 43 is started to supply cleaning water from the cleaning water tank 42 and then the electromagnetic valve 44 is opened to drip the cleaning water from the cleaning water dripping tube 41 onto the rotary disc 37.

After completing the preparatory operation in the foregoing manner, the unit 11 is moved down to start the cleaning operation. In this state, the cleaning head 14 is positioned at the lower end portion in the opening portion 12 of the unit 11 and the movable member 26 is disposed at the innermost position in the cleaning head 14.

Figure 6:
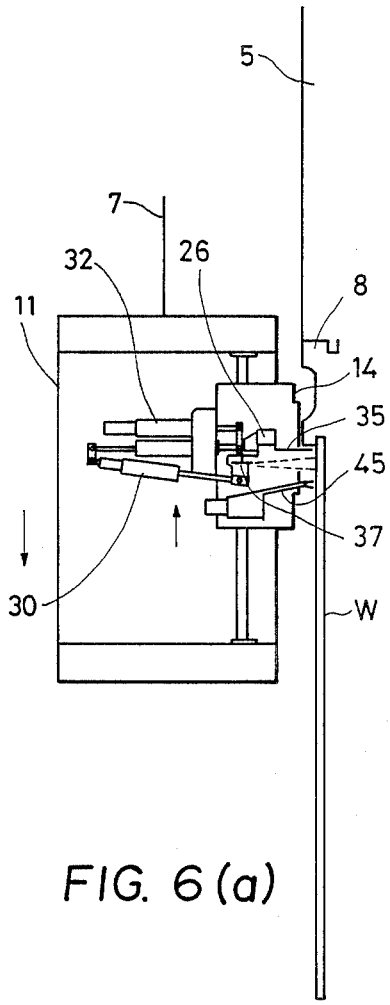
FIGS. 6(*a*) through 6(*d*) are diagrams for explaining the operation of the embodiment.
Figure 6:
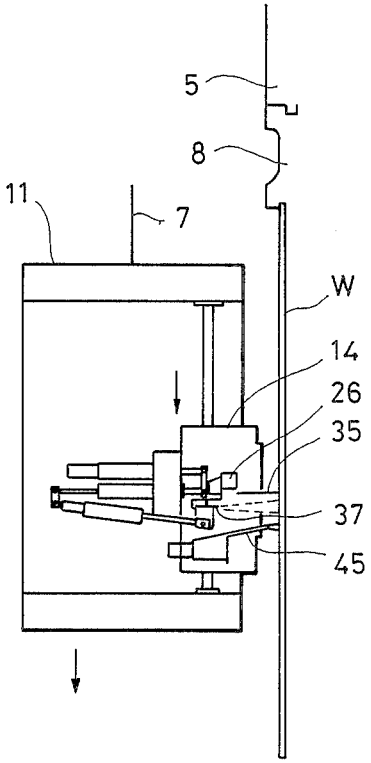
Figure 6:
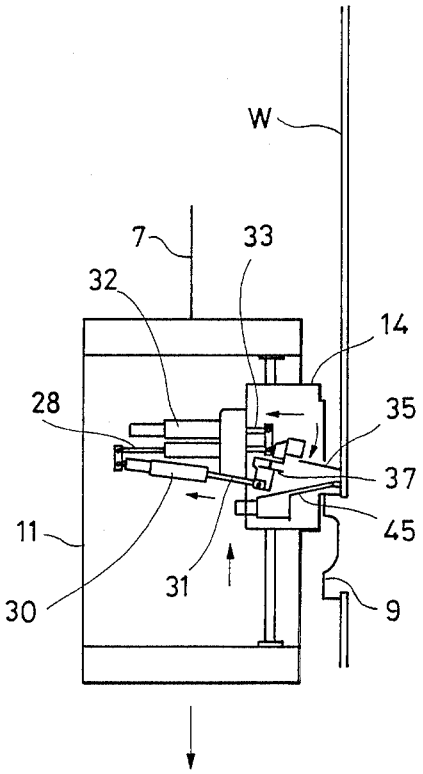
Figure 6:
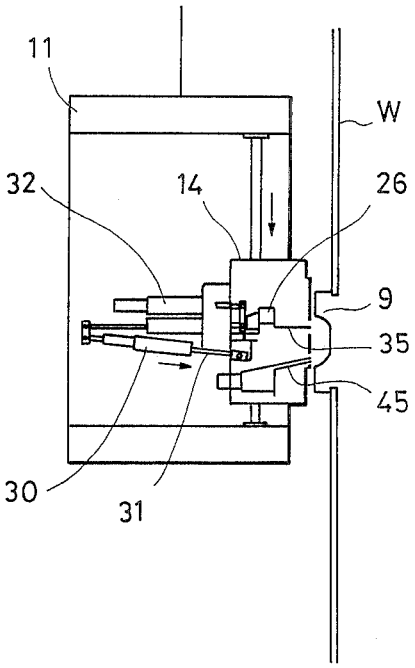
Figure 7:
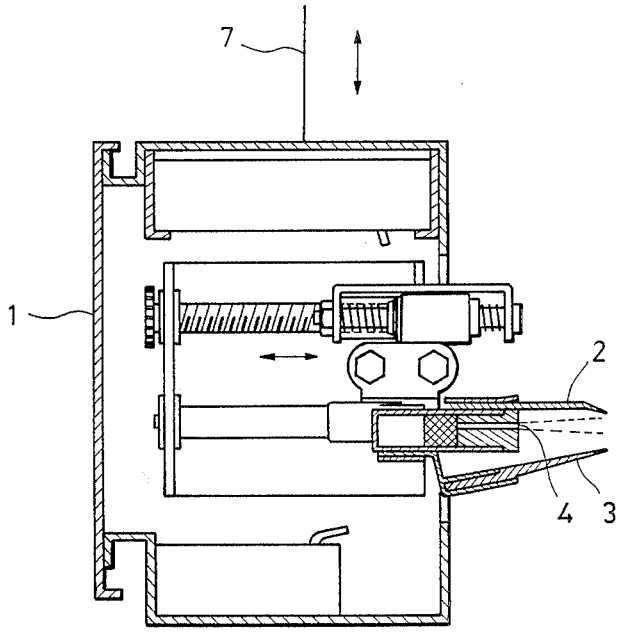
FIG. 7 PRIOR ART
FIG. 7 is a cross sectional view of a prior art cleaning apparatus.

Then the unit 11 is moved down and, when the unit 11 has passed the upper edge of an upper horizontal frame 8 of the uppermost windowpane W and then the lower edge of the frame 8 and the scraper 35 has been lowered to the lower edge of the frame 8 (see FIG. 6(*a*)), the cleaning head 14 is elevated by the lift motor 19 at an ascending velocity which is substantially equal to that of the descending velocity of the unit 11. The relative velocity of the unit 11 thereby is reduced to zero and the scraper 35 therefore is held at the lower edge of the upper horizontal frame 8 notwithstanding that the unit 11 is being moved down. The rotary disc 37 is rotated by driving the water sprinkling motor 36 to start sprinkling of the cleaning water and the movable member 26 is advanced by actuating the approaching and withdrawing cylinder 32 to cause the scraper 35 to abut against the windowpane 35.

After advancing the movable member 26 in this manner, the cleaning head 14 is moved down as shown in FIG. 6 (*b*) to perform wiping of the windowpane in association with the downward movement of the unit 11. The wiping of the windowpane W is performed by sprinkling the cleaning water by the rotary disc 37 and wiping off dust and the soiled water with the scraper 35. The soiled water is guided into the cleaning head 14 along an air curtain formed by the air curtain nozzle 45 and the upper surface of the air curtain nozzle 45 and collected from the recessed portion 48 into the soiled water tank 50 through the collecting tube 49.

In this state, the scraper 35 only is in contact with the windowpane W so that frictional resistance is relatively small thereby enabling the unit 11 to move down smoothly. Besides, even if the scraper 35 is not in strict parallelism with the windowpane W, the approaching and withdrawing cylinder 32 functions as a buffer so that the cleaning work can be performed without any trouble.

Thereafter, as shown in FIG. 6(*c*), when the unit 11 has moved down to a position at which the scraper 35 in the cleaning head 14 has reached the upper edge of a lower horizontal frame 9 of the windowpane W, the cleaning head 14 is elevated by the lift motor 19 at an ascending velocity which is substantially equal to the descending velocity of the unit 11 thereby to reduce the relative velocity to zero. Thus, the scraper 35 is held at the upper edge of the lower horizontal frame 9 notwithstanding that the unit 11 is being moved down. Simultaneously, the compressed air in the approaching and withdrawing cylinder 32 is exhausted to withdraw the rod 33 and thereby withdraw the movable member 26 and the scraper 35 while the rod 31 is withdrawn by supplying compressed air to the tilting cylinder 30. The movable member 26 therefore is tilted downwardly about the pin at the foremost end of the guide rod 28 so that the scraper 35 is moved in a pivotal motion to the corner portion of the windowpane W along the surface of the windowpane W. By the combined movement of withdrawing and downward tilting of the scraper 35, the corner portion at the lower edge of the windowpane W can be completely cleaned.

Then, as shown in FIG. 6(*d*), compressed air in the tilting cylinder 30 is exhausted to stretch the rod 31 and restore the movable member 26 to the original horizontal state and the cleaning head 14 is moved down to pass the lower horizontal frame 9 while avoiding contact with the frame 9.

In this manner, cleaning of one windowpane W between the upper horizontal frame 8 and the lower horizontal frame 9 is completed.

Accordingly, by repeating the above described operation, cleaning of one span corresponding to the width (i.e., horizontal length) of the unit 11 is performed. After completing cleaning of the lowermost windowpane W, the downward movement of the unit 11 is stopped and, while the suction fans 55 and the cylinder 59 for the guide rollers 57 are operated, the operation of the other elements is stopped. The unit 11 is moved up to the roof car 6 and is moved to other windowpanes to be cleaned. If necessary, the soiled water contained in the soiled water tank 50 is drained out of the unit 11 through the draining pump 51 and cleaning water is supplemented in the cleaning water tank 42.

Since the movable member 26 provided with the scraper 35 is supported by the elevating cylinder 30 and the approaching and withdrawing cylinder 32, a buffer function by the compressed air can be obtained in addition to the tilting movement and the approaching and withdrawing movements. Absorption of impact can therefore be performed without providing a particular buffer mechanism such as a spring. Likewise, the stretching and withdrawing movements and buffer operation can be effected by the cylinder 59 with respect to the guide rollers 57 so that simplification of the construction and reduction of weight can be realized.

Since the movable member 26 provided with the scraper 35 is driven by the two cylinders 30 and 32, an arrangement may be adopted so that the scraper 35 is withdrawn into the cleaning head 14 when the actuating fluid is not supplied so that the unit 11 can be simply moved up or down manually when stoppage of electric current has occurred.

If position detection sensors are mounted on the respective guide rollers 57 to detect positions of the unit 11 and the cleaning head 14 and the position and posture of the movable member 26 are controlled in accordance with the detected positions, a completely automatic cleaning work can be performed.

In the above described embodiment, ascending and descending of the cleaning head are made by using chains. Alternatively, other mechanism such as a feed screw may be employed for ascending and descending the cleaning head.

The cylinder for driving the movable member is not limited to a pneumatic cylinder but may be a cylinder actuated by othe type of fluid pressure (e.g., hydraulic pressure). For driving the movable member, a device other than a cylinder may be used if it can perform the approaching and withdrawing movements as well as the tilting movement.

Instead of the rotary disc for sprinkling water which comprises the radially extending flat portions, the rotary disc may be of a circular disc provided with projections thereon.

Instead of using a single unit 11, a plurality of units 11 may be connected horizontally to broaden the range of wiping.

In the above embodiment, the guide rollers and the suction fans are provided for supporting reaction of the unit 11. Either the guide rollers or the suction fans may however be omitted.

What is claimed is:

1. An apparatus for cleaning windowpanes comprising:

a unit movable in either an ascending or descending manner along a side surface of a structure having a windowpane and formed with an opening portion in a portion facing the windowpane;

a cleaning head vertically movable in either the same direction or the opposite direction as said unit in said opening portion of said unit;

drive means for driving said cleaning head in one direction at a velocity substantially equal to the velocity of the unit as the unit moves in the opposite direction to the driven cleaning head whereby the velocity of movement of said cleaning head relative to the windowpane is substantially zero;

a moveable member provided in said cleaning head;

means for moving said movable member to approach and withdraw from the windowpane and also to be tilted with respect to the windowpane;

a scraper mounted on said movable member for cleaning the windowpane in abutting engagement therewith;

a rotary disc mounted on a rotary shaft which is provided substantially vertically with respect to said movable member;

cleaning water supply means for dripping cleaning water onto said rotary disc;

means for forming an air curtain provided below said movable member in said cleaning head, said air curtain being located opposite to said scraper and guiding soiled water flowing along the windowpane; and soiled water collecting means for collecting soiled water guided along said air curtain.

2. An apparatus as defined in claim 1 wherein said means for moving said movable member comprises fluid pressure actuated cylinders.

3. An apparatus as defined in claim 1 wherein said rotary disc has a mounting portion by which said rotary disc is mounted to said rotation shaft and flat portions radially extending from said mounting portion, a rear end portion in the direction of rotation of each flat portion being bent upwardly and a front end portion of each flat portion being bent downwardly.

* * * * *